United States Patent [19]

van Engelen et al.

[11] 4,255,687

[45] Mar. 10, 1981

[54] LOW PRESSURE MERCURY VAPOR DISCHARGE LAMP

[75] Inventors: Hielke A. van Engelen; Petrus J. M. Willemsen, both of Roosendaal, Netherlands

[73] Assignee: U.S. Philips Corporation, New York, N.Y.

[21] Appl. No.: 4,648

[22] Filed: Jan. 19, 1979

[30] Foreign Application Priority Data

Feb. 10, 1978 [NL] Netherlands ..... 7801534

[51] Int. Cl.[3] ..... H01J 61/35; H01J 61/42

[52] U.S. Cl. ..... 313/488; 313/113; 313/493

[58] Field of Search ..... 313/488, 489, 493, 113

[56] References Cited

U.S. PATENT DOCUMENTS

| | | | |
|---|---|---|---|
| 3,141,990 | 7/1964 | Ray | 313/221 |
| 3,379,917 | 4/1968 | Menelly | 313/488 |
| 3,541,376 | 11/1970 | Sadoski et al. | 313/489 |

*Primary Examiner*—Palmer C. Demeo

*Attorney, Agent, or Firm*—Robert S. Smith

[57] ABSTRACT

Low pressure mercury vapor discharge lamp having a cylindrical discharge vessel the inner surface of which is, at least partly, coated with a luminescent layer, a reflecting layer containing titanium dioxide being provided between the said surface and the luminescent layer over a portion of the circumference between the ends of the discharge vessel. The reflecting layer contains up to 10% by weight of fine-grained silicon dioxide, thereby increasing the luminous flux emitted by the lamp.

2 Claims, 2 Drawing Figures

LOW PRESSURE MERCURY VAPOR DISCHARGE LAMP

Figure 1:
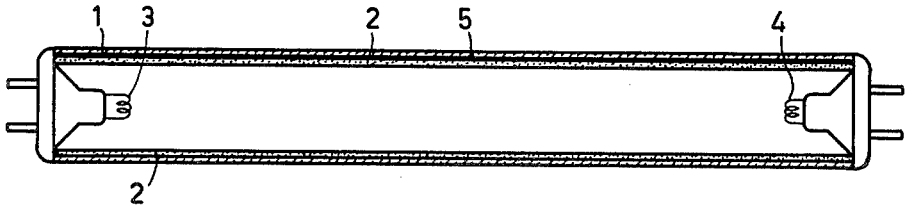

The invention relates to a low pressure mercury vapor discharge lamp having a cylindrical discharge vessel the inner surface of which is, at least partly coated, with a luminescent layer, a reflecting layer containing titanium dioxide being provided between the said surface and the luminescent layer over a portion of the circumference between the ends of the discharge vessel. Such a lamp is described in U.S. Pat. No. 3,379,917.

In such lamps the reflecting layer is provided on a portion of the inner surface, while on top of it a luminescent layer is provided over the entire lamp circumference. Alternatively, it is possible for the luminescent layer to extend only over the reflecting layer so as to form a slit-like gap which is free of reflecting as well as of luminescent material. Lamps of this type are often used in copying apparatus. The luminous flux of the light emitted through the slit is greater compared to a lamp not provided with a reflecting layer.

It is an object of the invention to increase the luminous flux of the lamps described above by improving the reflection properties of the reflecting layer.

In accordance with the invention a low pressure mercury vapor discharge lamp of the type defined in the preamble is characterized in that the reflecting layer contains up to 10% by weight of fine-grained silicon dioxide.

Experiments showed that if a certain percentage by weight of such fine-grained silicon dioxide (preferably having a particle size below 1 μm) is added to the titanium dioxide-containing reflecting layer the luminous flux of lamps having such a reflecting layer is approximately 6% higher compared to lamps having a reflecting layer which does not contain silicon dioxide. Favorable results were obtained, for example, with silicon dioxide having an average particle size of 0.25 μm, for example "Hisil" or "Aerosil" (Trade Marks).

In one particular embodiment of a low pressure mercury vapor discharge lamp according to the invention the reflecting layer further contains up to 5% by weight of antimony trioxide. Adding antimony trioxide to a reflecting layer in a lamp according to the invention has a favorable influence on starting of the lamp, while the luminous flux of the lamp remains at the highest possible value during operation of the lamp.

An embodiment of a low pressure mercury vapor discharge lamp according to the invention will now be further explained with reference to the drawing.

Figure 2:
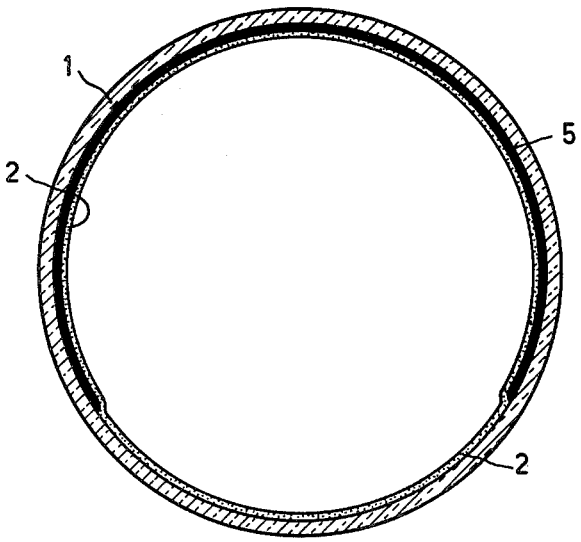

In the drawing:

FIG. 1 shows schematically a longitudinal cross-section of a low pressure mercury vapor discharge lamp according to the invention having a power of 25 W, and FIG. 2 is a cross-sectional view of the same lamp.

Referring to FIG. 1, reference numeral 1 denotes the glass wall of a discharge vessel which is coated at the inner surface with a layer of luminescent material 2, consisting, for example, of green luminescing, terbium-activated cerium magnesium aluminate. Electrodes 3 and 4 are disposed one at each end of the discharge vessel (length approximately 44 cm, inside diameter 25 mm). In addition, the discharge vessel contains a quantity of mercury and a rare gas (for example argon at a pressure of 3 torr) or a combination of rare gasses. A thin layer of reflecting material, (see also FIG. 2) is present over substantially the entire length of the discharge vessel between the luminescent layer 2 and the glass wall 1. The cross sectional view of the lamp shown in FIG. 2 clearly shows that the layer 5 covers approximately 75% of the tube circumference of the discharge vessel. A plurality of tests were performed on the lamps described above, the luminous flux being determined after 100 hours. The reflecting layer consisted in lamp I of titanium dioxide to which approximately 2% by weight of $Sb_2O_3$ was added and the reflecting layer of lamp II of titanium dioxide and 2% by weight of $Sb_2O_3$ to which approximately 3% by weight of finely distributed silicon dioxide ("Aerosil", average grain size approximately 0.25 μm) was added. After 100 hours of operation, lamps of type II gave approximately 6% more luminous flux than lamps of type I.

What is claimed is:

1. A low pressure mercury vapor discharge lamp which comprises:

a cylindrical discharge vessel having an inner surface;

a reflecting layer containing titanium dioxide disposed on said inner surface except for an axially elongated aperture, said reflecting layer containing a finite quantity of silicon dioxide which is up to 10% by weight of the total weight of said reflecting layer, said silicon dioxide having an average particle size which is substantially equal to 25 micrometers;

a luminescent layer disposed over substantially all of said reflecting layer and on said inner envelope over substantially all of said axially elongated aperture; and said axially elongated aperture having a coating which is substantially free of silicon dioxide.

2. A low pressure mercury vapor discharge lamp as claimed in claim 1 wherein said reflecting layer contains up to 5% by weight of antimony trioxide.

* * * * *